United States Patent [19]

Edwards

[11] Patent Number: 4,708,154

[45] Date of Patent: Nov. 24, 1987

[54] NONSLIP CRUTCH FOOT ASSEMBLY

[76] Inventor: Robert J. Edwards, 6916 W. 65th Ter., Overland Park, Kans. 66202

[21] Appl. No.: 804,853

[22] Filed: Dec. 5, 1985

[51] Int. Cl.[4] ..... A45B 9/04; A45B 7/00

[52] U.S. Cl. ..... 135/84; 135/86; 403/227; 403/104; 248/346.1

[58] Field of Search ..... 135/84, 86, 77; 16/38, 16/39; 403/227, 104, 373; 272/70, 70.1, 70.3, 70.4; 248/346.1

[56] References Cited

U.S. PATENT DOCUMENTS

| | | | |
|---|---|---|---|
| 521,811 | 6/1894 | Piepenbring | 272/70.1 |
| 679,468 | 7/1901 | Pratt | 135/84 |
| 1,305,867 | 6/1919 | Atlas | 135/78 |
| 1,518,382 | 12/1924 | Beecroft | 138/80 |
| 1,879,429 | 9/1932 | Noelting | 403/227 |
| 2,155,826 | 4/1939 | Herold | 16/38 |
| 2,301,385 | 11/1942 | Ehrgott | 248/346.1 |
| 2,429,409 | 10/1947 | Eidman | 135/86 X |
| 2,430,737 | 11/1947 | Roe | 16/39 |
| 2,492,916 | 12/1949 | Chute | 135/80 |
| 2,501,890 | 3/1950 | Desso | 135/70 |
| 2,642,884 | 6/1953 | Henderson | 135/86 |
| 2,835,493 | 5/1958 | Skaggs | 272/70.1 |
| 3,170,475 | 2/1965 | Forbes | 135/80 |
| 3,199,886 | 8/1965 | Dover | 280/82 |
| 3,448,749 | 6/1969 | Stark | 135/70 |
| 4,135,536 | 1/1979 | Willis | 135/84 |
| 4,411,284 | 10/1983 | Opitz | 135/81 |

*Primary Examiner*—Richard J. Johnson

*Attorney, Agent, or Firm*—Kokjer, Kircher, Bradley, Wharton, Bowman & Johnson

[57] ABSTRACT

A nonslip foot assembly for the lower end of a crutch, cane, walker or other walking aid. An expansible sleeve is anchored in the end of the crutch by rotating a threaded bolt in order to squeeze the sleeve between a pair of nuts. The end of the bolt projects out of the crutch and is pivotally pinned to a nonslip foot formed by a rigid disk bonded to a resilient pad having a plurality of projecting fingers. The fingers flex when applied to a hard surface and their resiliency applies a firm gripping force even if the surface is slippery. The fingers are able to dig into carpets and other soft surfaces to provide a firm grip without damaging the surface.

3 Claims, 5 Drawing Figures

NONSLIP CRUTCH FOOT ASSEMBLY

BACKGROUND AND SUMMARY OF THE INVENTION

This invention relates generally to crutches and other walking aids and deals more particularly with a crutch foot assembly which is constructed to prevent the crutch from slipping.

The tips of crutches, canes and walkers are typically equipped with a simple rubber end cap which is generally effective in preventing slippage on normal surfaces. However, the end cap often slips when a slick surface is encountered such as a wet floor, a tile or marble surface, or an icy or snow packed walkway. If the crutch, cane or walker should slip while the user's weight is applied to it, severe personal injury can result.

Although attempts have been made to provide walking aids with other types of nonslip feet, none of the proposed arrangements has been entirely satisfactory. Feet that have rigid metal spikes are effective on ice and snow, but they cannot be used indoors or on any surface which is susceptible to being damaged by the sharp spikes. Feet with treads, ribs, corrugations and other slip resistant components have also been proposed, but none of these components is entirely effective on all types of surfaces. The nonslip foot assemblies that have been proposed in the past are also undesirable in that they must be initially built into the crutch and cannot be added to an existing crutch having a standard rubber tip.

The present invention is directed to an improved nonslip crutch foot and has, as its principal goal, the provision of a foot which is more slip resistant than the devices that have been used in the past on crutches and other walking aids.

More specifically, it is an important object of the invention to provide a nonslip foot having a plurality of flexible and resilient fingers which are able to firmly grip against virtually any surface without slipping. The stiffness and length of the fingers are such that, when they are bent upon being pressed against an underlying surface, their tendency to return to their original straight condition applies a strong gripping force against the surface to assure that the foot will not slip, even if the surface is wet or icy or especially slick for some other reason.

Another important object of the invention is to provide a nonslip foot which can be used on both hard and soft surfaces without marring or otherwise damaging the surface. The resilient fingers are soft enough to avoid damaging wood floors and other hard surfaces, while they are able to dig into carpets and other soft floor coverings to provide a strong gripping force without damaging the floor covering.

A further object of the invention is to provide a nonslip foot assembly which can be initially built into a crutch or other walking aid or added to an existing crutch having a conventional rubber tip. The use of an expansible sleeve for anchoring the foot assembly in place is important because it permits the foot assembly to be installed on virtually any tubular member.

An additional object of the invention is to provide a foot assembly of the character described which can be quickly and easily installed without the need for any special skills or equipment.

A still further object of the invention is to provide a foot assembly of the character described which is simple and economical and which does not detract from the appearance of the crutch.

Yet another object of the invention is to provide a foot assembly of the character described which has a sturdy construction and which functions reliably as long as the crutch or other walking aid is used.

Other and further objects of the invention, together with the features of novelty appurtenant thereto, will appear in the course of the following description.

DESCRIPTION OF THE DRAWING

In the accompanying drawing which forms a part of the specification and is to be read in conjunction therewith and in which like reference numerals are used to indicate like parts in the various views.

DETAILED DESCRIPTION OF THE INVENTION

Figure 1:
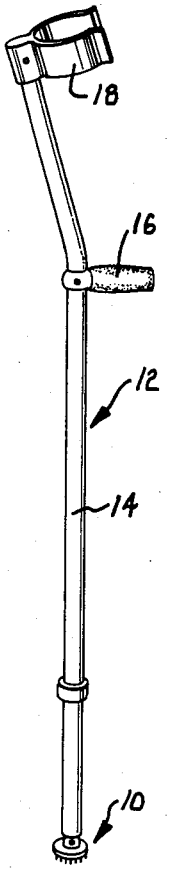
FIG. 1 is a perspective view of a forearm crutch equipped with a nonslip foot assembly constructed according to a preferred embodiment of the present invention.
Figure 2:
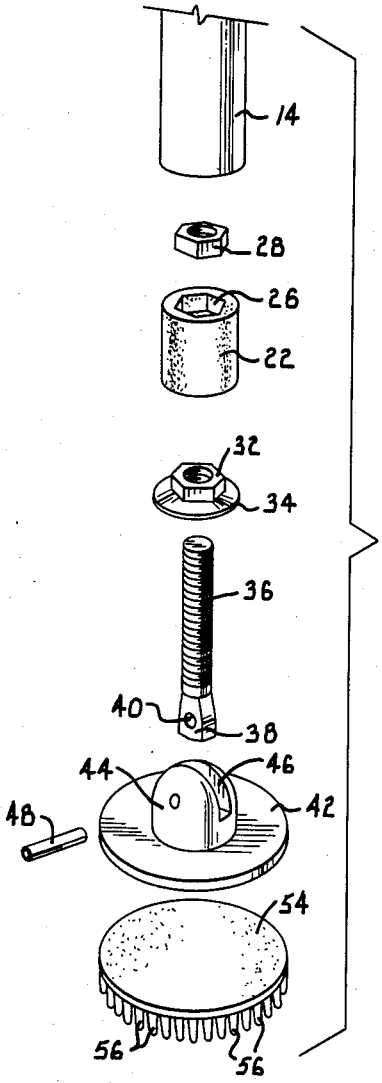
FIG. 2 is an exploded perspective view on an enlarged scale showing the components of the foot assembly.

Referring now to the drawing in more detail, numeral 10 generally designates a nonslip foot assembly constructed in accordance with the present invention. While the foot assembly 10 is shown in FIG. 1 installed on a forearm crutch, it is to be understood that it is equally useful on other types of crutches and on canes, walkers and other walking aids. The crutch 12 has a staff 14 which is of tubular construction and which is provided with a hand grip 16 and a forearm support 18. The staff 14 has a hollow tubular wall 20 which may be constructed of metal or any other suitable material.

The foot assembly 10 includes a cylindrical sleeve 22 which may be constructed of rubber or another material having similar properties. Sleeve 22 has a size to be fitted closely in the lower end of the crutch. A passage 24 (see FIG. 3) extends axially through the sleeve. When the sleeve 22 is axially compressed, it expands radially or laterally against the inside surface of the crutch wall 20 in order to anchor the sleeve in place.

The top end of sleeve 22 is provided with a hexagonal recess 26 having a size and shape to closely receive a conventional internally threaded nut 28. The opposite or lower end of sleeve 22 has a bottom shoulder 30. A flange nut 32 has an internally threaded hexagonal body with an integral circular flange 34. The bottom shoulder 30 of sleeve 22 rests on the hexagonal body of flange nut 32 while the flange 34 is large enough to cover the lower end of the crutch 12 in position to carry most of the load on the crutch as will be apparent.

A threaded bolt 36 extends through the passage 24 and is threaded through both of the nuts 28 and 32. The lower end of bolt 36 is flattened at 38, and the flattened end 38 is provided with an opening 40.

Pivotally mounted on the lower end of bolt 36 is a foot which includes a disk 42. A bifurcated clevis 44 is formed integrally with disk 42 and is provided with a slot 46 having a size to closely receive the flattened end 38 of the bolt. A roll pin 48 extends through both halves of the clevis 44 and also through opening 40 in order to mount the foot on bolt 36 for pivotal movement about the axis of the roll pin 48. The roll pin 48 is generally horizontal and is oriented perpendicular to the lower end of the crutch 12. The roll pin is also transverse to the direction of movement of a user of the crutch.

Figure 3:
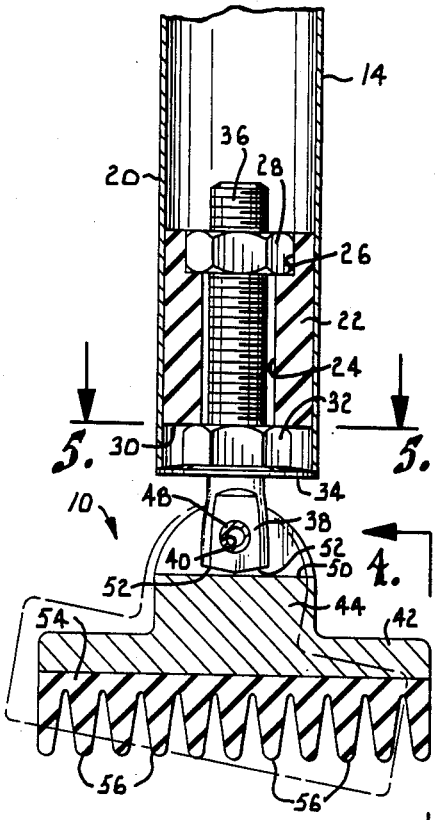
FIG. 3 is a fragmentary sectional view on an enlarged scale taken on a vertical plane through the crutch assembly and the lower end of the crutch.

As best shown in FIG. 3, a flat surface 50 is formed on clevis 44 at the base of slot 46. The bottom end of bolt 36 includes a pair of inclined surfaces 52 which meet at the center. Each surface 52 inclines upwardly at an angle of about 10° from horizontal. Engagement of surfaces 52 against surface 50 limits the pivotal movement of disk 42 in both directions, since further pivoting cannot take place once surface 50 has been engaged by either of the surfaces 52. In this manner, the pivotal movement of the foot is limited to about 10° in each direction about the axis of the roll pin 48. It has been found that this is sufficient pivotal movement to accommodate normal use of the crutch.

Figure 4:
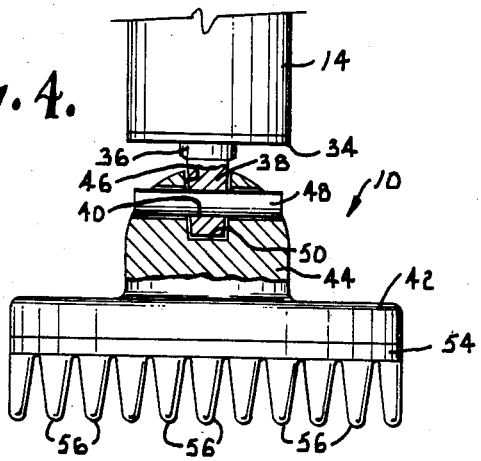
FIG. 4 is a fragmentary elevational view, taken generally along line 4—4 of FIG. 3 in the direction of the arrows with portions shown in section for illustrative purposes.
Figure 5:
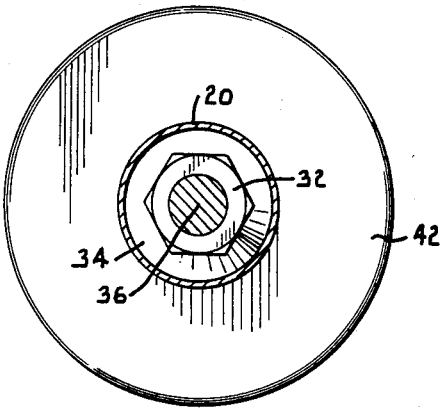
FIG. 5 is a sectional view taken generally along line 5—5 of FIG. 3 in the direction of the arrows.

A circular pad 54 is glued or otherwise bonded to the bottom surface of disk 42. Projecting downwardly from pad 54 are a plurality of flexible and resilient fingers 56. Each finger 56 tapers somewhat as it extends downwardly away from the body of pad 54. The tips of the fingers 56 are rounded somewhat, as best shown in FIGS. 3 and 4. The pad 54 and fingers 56 are preferably constructed of rubber, and the fingers should be flexible enough to bend when applied to an underlying surface with pressure applied to the crutch. At the same time, the fingers should be stiff enough to spring against the deflection in a manner to firmly grip against the surface. It has been found that good results are achieved if the fingers are approximately one-half inch long each. The fingers are parallel to one another and are arranged on pad 54 in straight rows and columns, with the center to center distance between the fingers in each row and column being approximately one-fourth inch. The pad 54 preferably has a diameter of approximately three inches so that the foot has as relatively large surface area for contact with the underlying surface.

The foot assembly 10 is installed by first inserting sleeve 22 into the lower end of the crutch with the sleeve in its relaxed condition and nut 28 seated in recess 26. Bolt 36 is threaded through the flange nut 32, extended through passage 24 and threaded through nut 28. Because nut 28 fits closely in recess 26 and is complemental in shape to the recess, nut 28 cannot turn as bolt 36 is rotated to thread it into the nut. The lower nut 32 is inserted into the crutch against the sleeve lower shoulder 30, and bolt 36 is rotated to draw the two nuts 28 and 32 toward one another by threaded action. The nuts thus axially compress sleeve 22 which in turn causes the sleeve to expand radially or laterally against the inside surface of wall 20, thereby securely anchoring the sleeve in place in the lower end of the crutch. The flat end 38 of bolt 36 projects through and below flange 34 beyond the lower end of the crutch. After pad 54 has been bonded to disk 42, clevis 44 is applied to the flat end 38 of the screw, and the roll pin 48 is then inserted through the clevis and through opening 40 in the bolt.

When the crutch is used, the flexible fingers 56 are pressed against the underlying surface and bend. The fingers resist their deformation and thereby are able to firmly grip against the surface, even if it is icy, snow packed, wet or otherwise slick. The softness and resiliency of the fingers 56 prevents them from marring or otherwise damaging wood floors, tiles, linoleum or other relatively hard surfaces. The fingers are also able to dig into carpets and other relatively soft floor coverings in order to provide a strong grip without damage to the floor covering. The provision of a large number of fingers results in a large number of points of contact between the foot and surface to enhance the gripping ability and resistance to slipping.

The foot is able to pivot in limited fashion about pin 48, and the pivotal movement is allowed to the extent necessary in normal use of the crutch. The foot is able to pivot only about the axis of pin 48 which is oriented transversely to the direction of movement of the person using the crutch. Consequently, undue wobbling or rocking of the foot in various directions is prevented, the foot is also prevented from pivoting beyond the limiting positions, and the stability is enhanced accordingly.

It is to be noted that the use of the expansible sleeve 22 for anchoring of the foot assembly 10 permits the foot assembly to be applied both as an original part of a new crutch and also as a replacement for the standard rubber tip or end cap of an existing crutch, cane, walker or other walking aid. The flange 34 covers the lower end of the crutch and thus encloses sleeve 22 and nuts 28 and 32 within the crutch to avoid detracting from the appearance of the crutch or other walking aid.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A nonslip foot assembly for a crutch having a tubular lower end, said foot assembly comprising:

a deformable sleeve closely fitted in said lower end of the crutch, said sleeve being laterally expansible in the lower end of the crutch to become anchored therein when the sleeve is axially compressed;

first and second threaded nuts above and below said sleeve;

a threaded bolt extending through said sleeve and threaded through said first and second nuts, said bolt being rotatable to move the nuts toward one another, thereby axially compressing said sleeve to effect lateral expansion thereof for anchoring the sleeve in the lower end of the crutch;

a foot having a nonslip surface thereon comprising a plurality of flexible and resilient fingers projecting from the foot for gripping against an underlying surface to which said fingers are applied; and means for mounting said foot on said bolt in a manner permitting the foot to pivot about a pivot axis oriented substantially perpendicular to the lower end of the cruct, wherein said foot includes a rigid disk pivotally connected with said bolt and a resilient pad bonded to said disk, said fingers projecting from said pad.

2. The foot assembly of claim 1, wherein said mounting means comprises a clevis on said disk and a pivot pin coupling said clevis with said bolt for pivotal movement of the clevis about the pivot pin.

3. The foot assembly of claim 2, including cooperating surfaces on said clevis and bolt engaging one another to limit pivotal movement of the clevis about said pin.

* * * * *